US005689763A

United States Patent [19]

Rathbun et al.

[11] Patent Number: 5,689,763

[45] Date of Patent: Nov. 18, 1997

[54] CAPACITIVE BASED SENSING SYSTEM FOR USE IN A PRINTING SYSTEM

[75] Inventors: Darrel R. Rathbun, Ontario; John J. Ricciardelli, Poughkeepsie; Gerald A. Domoto, Briarcliff Manor, all of N.Y.

[73] Assignee: Xerox Corporation, Stamford

[21] Appl. No.: 715,268

[22] Filed: Sep. 16, 1996

[51] Int. Cl.[6] ..... G03G 15/06

[52] U.S. Cl. ..... 399/53; 399/239; 430/117; 118/688

[58] Field of Search ..... 399/27, 28, 237, 399/238, 239, 240, 53; 430/117, 118, 119; 118/688, 690

[56] References Cited

U.S. PATENT DOCUMENTS 4,524,088 6/1985 Fagen, Jr. et al. ..... 427/10

OTHER PUBLICATIONS

*Patent Abstracts of Japan*, vol. 17, No. 29 (P1472), Published Jan. 20, 1993 and JP-A-04-251272, Sep. 7, 1992.

*Patent Abstracts of Japan*, vol. 16, No. 19 (P1300), Published Jan. 17, 1992 and JP-A-03-237476, Oct. 23, 1991.

*Primary Examiner*—R. L. Moses

*Attorney, Agent, or Firm*—Gary B. Cohen

[57] ABSTRACT

A sensing system for a print development system of a printing system in which a print is developed with developer material and development of the print varies as a function of both a first parameter and a second parameter is provided. The development system includes a capacitance and the sensing system, which measures a first value varying as a function of the first parameter and a second value varying as a function of the second parameter, includes a sensing subsystem for measuring an output by reference to the capacitance; and a signal development subsystem, responsive to the sensing system, for developing, from the output, both a first signal and a second signal with the first signal corresponding to the first value and the second signal corresponding to the second value.

19 Claims, 6 Drawing Sheets

CAPACITIVE BASED SENSING SYSTEM FOR USE IN A PRINTING SYSTEM

BACKGROUND OF THE INVENTION

This invention relates generally to a printing system employing a development subsystem and, more particularly, to a sensing arrangement adapted for use with the development subsystem for facilitating highly accurate measurements of various development related parameters.

Generally, the process of electrostatographic copying is initiated by exposing a light image of an original document to a substantially uniformly charged photoreceptive member. Exposing the charged photoreceptive member to light in an imagewise configuration discharges the photoconductive surface thereof in areas corresponding to non-image areas in the original input document while maintaining charge in image areas, resulting in the creation of a latent electrostatic image of the original document on the photoreceptive member. This latent image is subsequently developed into a visible image by a process in which developer material is deposited onto the surface of the photoreceptive member. Typically, this developer material comprises carrier granules having toner particles adhering triboelectrically thereto, wherein the toner particles are electrostatically attracted from the carrier granules to the latent image for forming a developed powder image on the photoreceptive member. Alternatively, liquid developer materials comprising a liquid carrier having toner particles immersed therein have been successfully utilized, wherein the liquid developer material is applied to the photoconductive surface with the toner particles being attracted toward the image areas of the latent image to form a developed liquid image on the photoreceptive member. Regardless of the type of developer material employed, the toner particles of the developed image are subsequently transferred from the photoreceptive member to a copy substrate, either directly or by way of an intermediate transfer member. Thereafter, the image may be permanently affixed to the copy substrate for providing a "hard copy" reproduction or print of the original document or file. In a final step, the photoreceptive member is cleaned to remove any charge and/or residual developing material from the photoconductive surface in preparation for subsequent imaging cycles.

The above described electrostatographic reproduction process is well known and is useful for light lens copying from an original as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images. Some of these printing processes develop toner on the discharged area, known as DAD, or "write black" systems, as distinguished from so-called light lens generated image systems which develop toner on the charged areas, also known as CAD, or "write white" systems. The subject invention applies to both such systems.

It has become highly desirable to provide the capability of producing color output prints through the use of electrostatic printing processes. As such, a so-called subtractive color mixing process has been developed for use in electrostatographic printing machines to produce a multicolor output image, whereby a full gamut of colors are created from three colors, namely cyan, magenta and yellow. These colors are complementary to the three primary colors, with various wavelengths of light being progressively subtracted from white light.

The use of liquid developer materials in imaging processes is well known. Likewise, the art of developing electrostatographic latent images formed on a photoconductive surface with liquid developer materials is also well known. Indeed, various types of liquid developing materials and development systems have heretofore been disclosed with respect to electrostatographic printing machines.

Liquid developers have many advantages, and often produce images of higher quality than images formed with dry toners. For example, images developed with liquid developers can be made to adhere to paper without a fixing or fusing step, thereby eliminating a requirement to include a resin in the liquid developer for fusing purposes. In addition, the toner particles can be made to be very small without the resultant problems typically associated with small particle powder toners, such as airborne contamination which can adversely affect machine reliability and can create potential health hazards. The use of very small toner particles is particularly advantageous in multicolor processes wherein multiple layers of toner generate the final multicolor output image. Further, full color prints made with liquid developers can be processed to a substantially uniform finish, whereas uniformity of finish is difficult to achieve with powder toners due to variations in the toner pile height as well as a need for thermal fusion, among other factors. Full color imaging with liquid developers is also economically attractive, particularly if surplus liquid carrier containing the toner particles can be economically recovered without cross contamination of colorants.

In a printing system using liquid development, it is common to apply liquid developer to a photoreceptor by way of an application roller upon which a layer of the liquid developer is maintained. It has been found that optimum development is facilitated by, among other things, maintaining the layer at a selected thickness. In one example, such thickness is obtainable through use of developer thickness control system of the type disclosed in U.S. Pat. No. 4,524,088 to Fagen, Jr. et al.(Fagen), the disclosure of which is incorporated herein by reference.

Fagen discloses a technique in which developer thickness is obtained with an arrangement including a capacitive sensing subsystem communicating with suitable processing circuitry. Developer is provided to the application by way of an actuator, such as a motor. As shown, the capacitive sensing subsystem is defined by a surface of an application roller and a bar spaced from the surface by a distance "d". The circuitry develops a train of pulses which are repetitive at a fixed frequency, and the duty cycle of which varies in accordance with the capacitance which is detected by the capacitive sensing subsystem. By virtue of the change of the capacitance into an electrical signal of varying duty cycle, the extremely small capacitance change may be used to develop an electrical signal of significant magnitude which may readily be used to control the supply of the developer by turning the actuator on and off.

In an ideal system, the developer application roller is perfectly round so that measurement of developer layer thickness, with a control system of the type disclosed by Fagen, is not affected by nonuniformities in the roller surface, i.e the distance d remains constant throughout the capacitive measurement. Nonetheless, it is believed that many rollers, at least to a certain degree, possess an irregular surface. The Fagen control system is believed to be well suited for use in a system where the thickness of the developer layer is relatively great compared with the magnitude of surface deviation. Where the thickness of the developer layer is relatively small compared with the magnitude of the surface deviation, however, thickness measurement will deviate substantially from an accurate measurement. In liquid developer applications, surface deviation can constitute affect thickness measurement significantly since the magnitude of the developer thickness can be quite small (e.g. 10–15 microns). It would thus be desirable to provide a system that takes advantage of the capacitive measuring approach while accommodating for the effect of surface irregularity on resulting measurements.

SUMMARY OF THE INVENTION

In accordance with the present invention, there is provided a sensing system for a print development system of a printing system in which a print is developed with developer material and development of the print varies as a function of both a first parameter and a second parameter. The development system includes a capacitance and the sensing system, which measures a first value varying as a function of the first parameter and a second value varying as a function of the second parameter, includes a sensing subsystem for measuring an output by reference to the capacitance; and a signal development subsystem, responsive to said sensing system, for developing, from the output, both a first signal and a second signal with the first signal corresponding to the first value and the second signal corresponding to the second value.

DESCRIPTION OF THE INVENTION

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
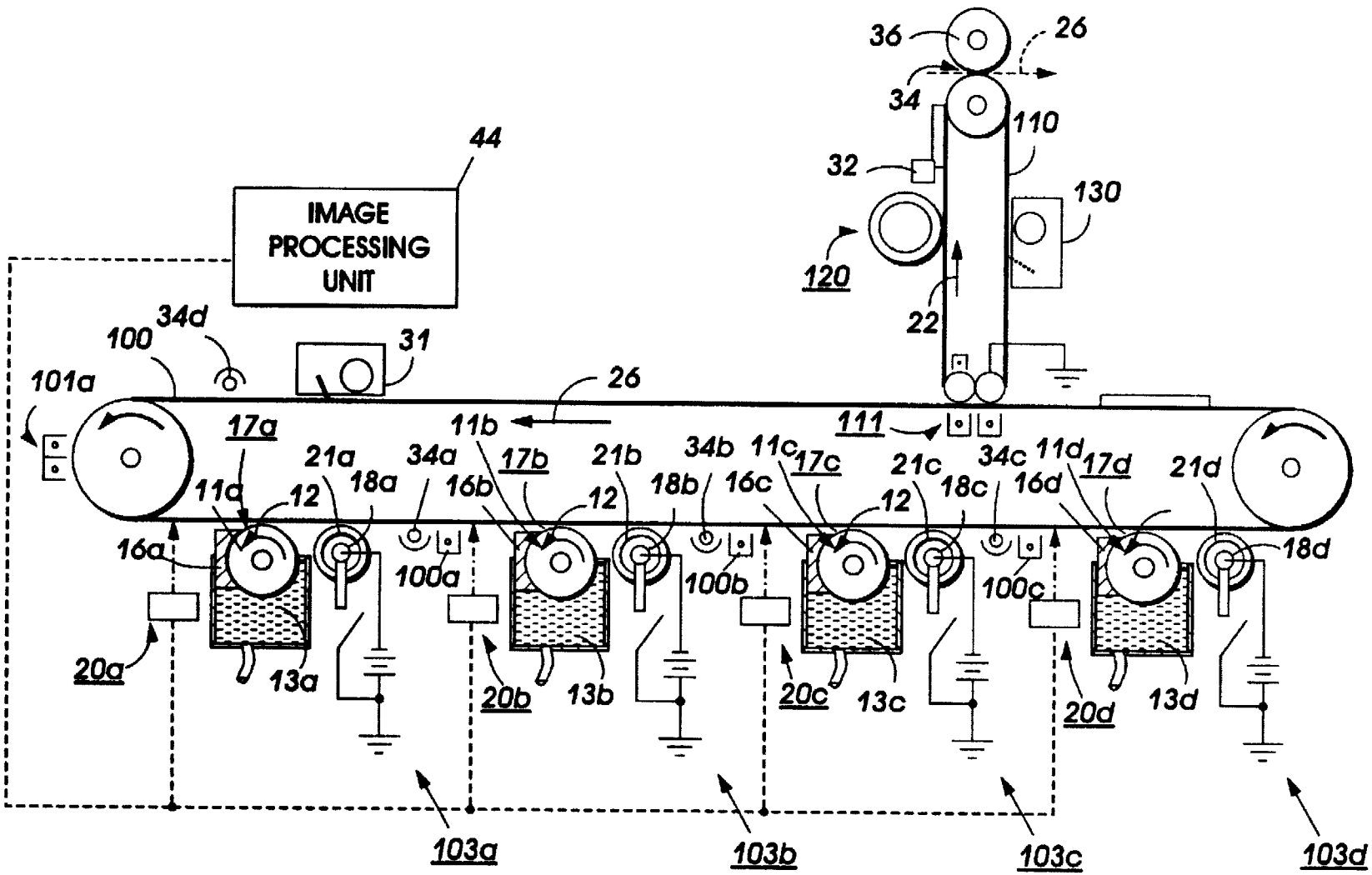
FIG. 1 is an elevational, partially schematic view of a printing system employing liquid ink development.

For a general understanding of the features of the present invention, reference numerals have been used throughout to designate identical elements. FIG. 1 schematically depicts the various elements of an illustrative color electrophotographic printing machine incorporating the present invention therein. It will become evident from the following discussion that the present invention is equally well suited for use in a wide variety of printing machines and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

Turning now to FIG. 1, there is shown a color document imaging system incorporating the present invention. The color copy process can begin by inputting a computer generated color image into the image processing unit 44. A digital signal which represent the blue, green, and red density signals of the image are converted in the image processing unit into four bitmaps: yellow (Y), cyan (C), magenta (M), and black (Bk). The bitmap represents the value of exposure for each pixel, the color components as well as the color separation. Image processing unit 44 may contain a shading correction unit, an undercolor removal unit (UCR), a masking unit, a dithering unit, a gray level processing unit, and other imaging processing sub-systems known in the art. The image processing unit 44 can store bitmap information for subsequent images or can operate in a real time mode.

The photoconductive member, preferably a belt of the type which is typically multilayered and has a substrate, a conductive layer, an optional adhesive layer, an optional hole blocking layer, a charge generating layer, a charge transport layer, and, in some embodiments, an anti-curl backing layer. It is preferred that the photoconductive imaging member employed in the present invention be infrared sensitive. This allows improved transmittance through cyan image. Belt 100 is charged by charging unit **101*a*. Raster output scanner (ROS) 20*a*, controlled by image processing unit 44, writes a first complementary color image bitmap information by selectively erasing charges on the belt 100. The ROS 20*a* writes the image information pixel by pixel in a line screen registration mode. It should be noted that either discharged area development (DAD) can be employed in which discharged portions are developed or charged area development (CAD) can be employed in which the charged portions are developed with toner. After the electrostatic latent image has been recorded, belt 100 advances the electrostatic latent image to development station 103*a*. Liquid developer material is supplied by replenishing systems through tube 210 to development station 103*a*, fountain 16A advances a liquid developer material 13*a* from the chamber of housing 14*a* to development zone 17*a*, where it meets roller 11, rotating. Roller 11 is electrically biased to generate a DC field, or AC field with DC offset just prior to the entrance to development zone 17*a*** so as to disperse the toner particles substantially uniformly throughout the liquid carrier. The toner particles, disseminated through the liquid carrier, pass by electrophoresis to the electrostatic latent image. The charge of the toner particles is opposite in polarity to the charge on the photoconductive surface.

After the image is developed it is conditioned at development station 103A. Development station **103*a* also includes porous roller 18*a* having porous outer skin. Roller 18*a* receives the developed image on belt 100 and conditions the image by reducing fluid content while inhibiting the offset of toner particles from the image, and by compacting the toner particles of the image. Thus, an increase in percent solids is provided to the developed image, thereby improving the stability of the developed image. Preferably, the percent solids in the developed image is increased to more than 20 percent solids. Porous roller 18***a* operates in conjunction with vacuum 19 (not shown) for removal of liquid from the roller. A roller (not shown), in pressure against the blotter roller 18*a*, may be used in conjunction with or in the place of the vacuum, to squeeze the absorbed liquid carrier from the blotter roller for deposit into a receptacle. Furthermore, the vacuum assisted liquid absorbing roller may also find useful application where the vacuum assisted liquid absorbing roller is in the form of a belt, whereby excess liquid carrier is absorbed through an absorbent foam layer. A belt used for collecting excess liquid from a region of liquid developed images is described in U.S. Pat. Nos. 4,299,902 and 4,258,115, the relevant portions of which are hereby incorporated by reference herein.

In operation, roller 18*a* rotates in direction 20 to impose against the "wet" image on belt 100. The porous body of roller 18*a* absorbs excess liquid from the surface of the image through the skin covering pores and perforations. Vacuum 19 located on one end of the central cavity of the roller, draws liquid that has permeated through roller 18*a* out through the cavity and deposits the liquid in a receptacle or some other location which will allow for either disposal or recirculation of the liquid carrier to the replenishing system of the present invention. Porous roller 18*a*, discharged of excess liquid, continues to rotate in direction 21 to provide a continuous absorption of liquid from image on belt 100. The image on belt 100 advances to lamp 34*a* where any residual charge left on the photoconductive surface is extinguished by flooding the photoconductive surface with light from lamp 34*a*.

The development takes place for the second color, for example, magenta, as follows: the developed latent image on belt 100 is recharged with charging unit 100*a*. The developed latent image is re-exposed by ROS 20*b*. ROS 20*b* superimposing a second color image bitmap information over the previous developed latent image. At development station 103B, roller 116*b*, rotating in the direction of arrow 12, advances a liquid developer material 13 from the chamber of housing 14 to development zone 17*b*. Fountain 16*b* positioned before the entrance to development zone 17*b* disperses the toner particles substantially uniformly throughout the liquid carrier. The toner particles, disseminated through the liquid carrier, pass by electrophoresis to the previous developed image. The charge of the toner particles is opposite in polarity to the charge on the previous developed image. Roller 18*b* receives the developed image on belt 100 and conditions the image by reducing fluid content while inhibiting the departure of toner particles from the image, and by compacting the toner particles of the image. Preferably, the percent solids is more than 20 percent, however, the percent of solids can range between 15 percent and 40 percent. The image on belt 100 advances to lamps 34*b* where any residual charge left on the photoconductive surface is extinguished by flooding the photoconductive surface with light from lamp 34*b*.

The resultant image, a multi layer image by virtue of the developing station 103*a*, 103*b*, 103*c* and 103*d* having black, yellow, magenta, and cyan, toner disposed therein advances to the intermediate transfer station. It should be evident to one skilled in the art that the color of toner at each development station could be in a different arrangement. The resultant image is electrostatically transferred to the intermediate member by charging device 111. The present invention takes advantage of the dimensional stability of the intermediate member to provide a uniform image deposition stage, resulting in a controlled image transfer gap and improved image registration. Further advantages include reduced heating of the recording sheet as a result of the toner or marking particles being pre-melted, as well as the elimination of electrostatic transfer of charged particles to a recording sheet. Intermediate member 110 may be either a rigid roll or an endless belt having a path defined by a plurality of rollers in contact with the inner surface thereof. The multi-layer image is conditioned by blotter roller 120 which receives the multi level image on intermediate member 110 and conditions the image by reducing fluid content while inhibiting the departure of toner particles from the image, and by compacting the toner particles of the image. Blotter roller 120 conditions the multi layer so that the image has a toner composition of up to 50 percent solids.

Subsequently, multi-layer image, present on the surface of the intermediate member, is advanced through image liquefaction stage B. Within stage B, which essentially encompasses the region between when the toner particles contact the surface of member 110 and when they are transferred to recording sheet 26, the particles are transformed into a tackified or molten state by heat which is applied to member 110 internally or externally. Preferably, the tackified toner particle image is transferred, and bonded, to recording sheet 26 with limited wicking by the sheet. More specifically, stage B includes a heating element 32, which not only heats the external surface of the intermediate member in the region of transfuse nip 34, but because of the mass and thermal conductivity of the intermediate member, generally raises the outer wall of member 110 at a temperature sufficient to cause the toner particles present on the surface to melt. The toner particles on the surface, while softening and coalescing due to the application of heat from the exterior of member 110, maintain the position in which they were deposited on the outer surface of member 110, so as not to alter the image pattern which they represent. The member continues to advance in the direction of arrow 22 until the tackified toner particles reach transfusing stage C. At transfuse nip 34, the liquefied toner particles are forced, by a normal force N applied through backup pressure roll 36, into contact with the surface of recording sheet 26. Moreover, recording sheet 26 may have a previously transferred toner image present on a surface thereof as the result of a prior imaging operation, i.e. duplexing. The normal force N, produces a nip pressure which is preferably about 100 psi, and may also be applied to the recording sheet via a resilient blade or similar spring-like member uniformly biased against the outer surface of the intermediate member across its width.

As the recording sheet passes through the transfuse nip the tackified toner particles wet the surface of the recording sheet, and due to greater attractive forces between the paper and the tackified particles, as compared to the attraction between the tackified particles and the liquid-phobic surface of member 110, the tackified particles are completely transferred to the recording sheet as image marks. Furthermore, as the image marks were transferred to recording sheet 26 in a tackified state, they become permanent once they are advanced past transfuse nip and allowed to cool below their melting temperature. The transfusing of tackified marking particles has the further advantage of only using heat to pre-melt the marking particles, as opposed to conventional heated-roll fusing systems which must not only heat the marking particles, but the recording substrate on which they are present.

After the developed image is transferred to intermediate member 110, residual liquid developer material remains adhering to the photoconductive surface of belt 100. A cleaning roller 31 formed of any appropriate synthetic resin, is driven in a direction opposite to the direction of movement of belt 100 to scrub the photoconductive surface clean. It is understood, however, that a number of photoconductor cleaning means exist in the art, any of which would be suitable for use with the present invention. Any residual charge left on the photoconductive surface is extinguished by flooding the photoconductive surface with light from lamp 34*d*.

Figure 2:
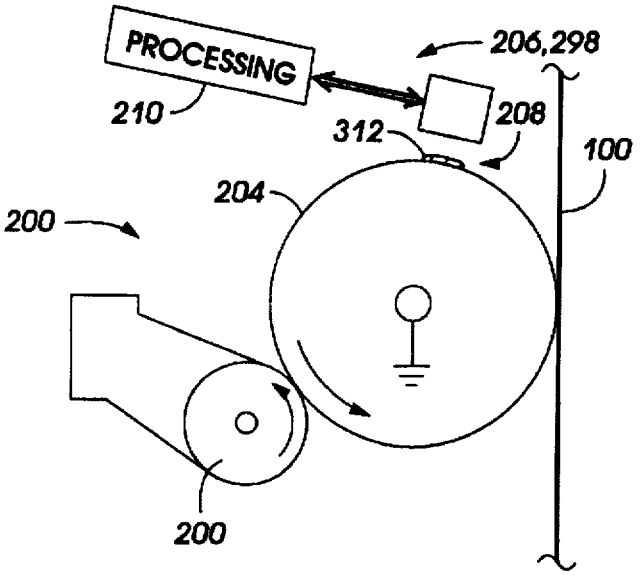
FIG. 2 is an elevational, partially schematic view of a development system operatively coupled with a capacitive based sensing system.

As will be recognized by those skilled in the art, the developer application subsystem described above can be implemented in a number of different approaches without affecting the concept upon which the currently described embodiments are based. Referring to FIG. 2, another embodiment of a developer application subsystem is designated by the numeral 200. The subsystem 200 includes a donor roll 202 which provides developer material to a developer application roll 204. In one example, developer material is provided from the donor roll by turning a motor (not shown) on and off. The application roll 204 serves as a ground plane for use in a capacitive sensing subsystem designated by the numeral 206. The capacitive sensing subsystem, which includes a sensing circuit 208 and a processing circuit 210, will be discussed in further detail below.

Prior to proceeding with a discussion of the circuitry used to implement the capacitive sensing subsystem 206 a discussion of capacitance sensing is provided. General capacitance sensing of thickness and other parameters is relatively simple. A stable oscillator is fed to the unknown capacitance through a series reference capacitor. The resulting output voltage across the unknown capacitance is inversely proportional to the unknown capacitance (a capacitance divider). The output waveform contains a wealth of information about what occurs between the unknown capacitor's plates. Anything that changes the spacing between the plates or the dielectric strength will affect the capacitance measurement. The relationship between spacing, dielectric strength and capacitance is $$C=(\epsilon A)/d$$

Where:

C=Capacitance $\epsilon$=Dielectric strength

A=Surface area of the plates d=Spacing between plates

Figure 3:
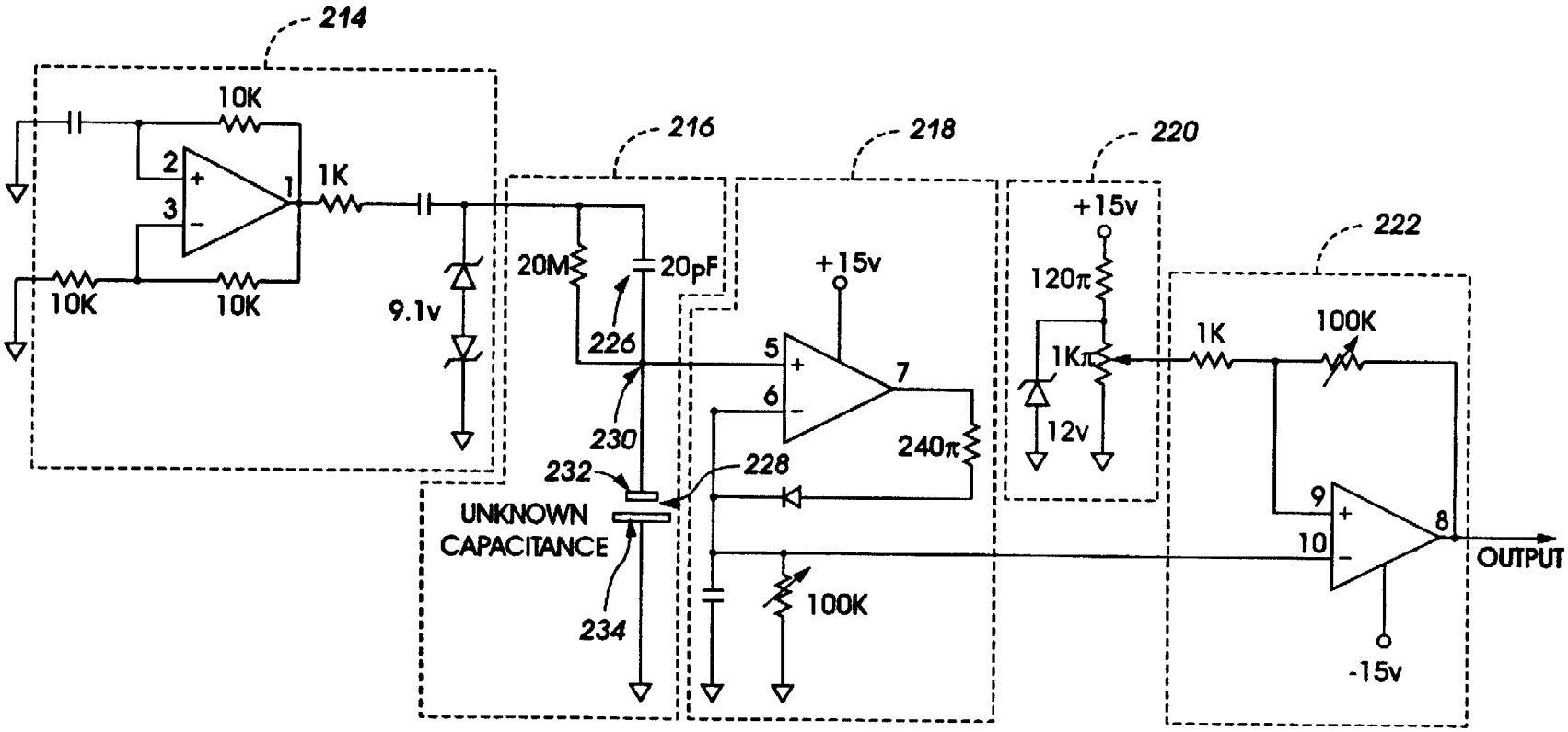
FIG. 3 shows circuitry suitable for implementing at least part of the capacitive based sensing system.

Referring to FIG. 3, one embodiment of the capacitive sensing subsystem 206 is shown in greater detail. The illustrated embodiment of FIG. 3 includes an oscillator 214, a capacitive divider 216, a peak hold circuit 218, a reference level setter 220 and an amplifier 222. In practice, the oscillator 214 operates as a square wave oscillator running at, in one example, 40 kHz. Output of the oscillator is communicated to the capacitive divider including capacitors 226, 228. A measuring node 230 is shifted as a function of change between the plates 232 (the surface of the roll 204) and 234 (a plate associated with the sensing circuit 208) of capacitor 228. Preferably, a 40 kHz 10.0v peak to peak square wave is used to drive the capacitors 226, 228 and the fraction of the total square wave across the unknown capacitance is processed. The peak or peak to peak value(s) of the voltage across the unknown capacitance is "grabbed" with the peak hold circuit 218, an offset is removed with the reference level setter 220, and the remaining signal is amplified with the amplifier 222.

Figure 4:
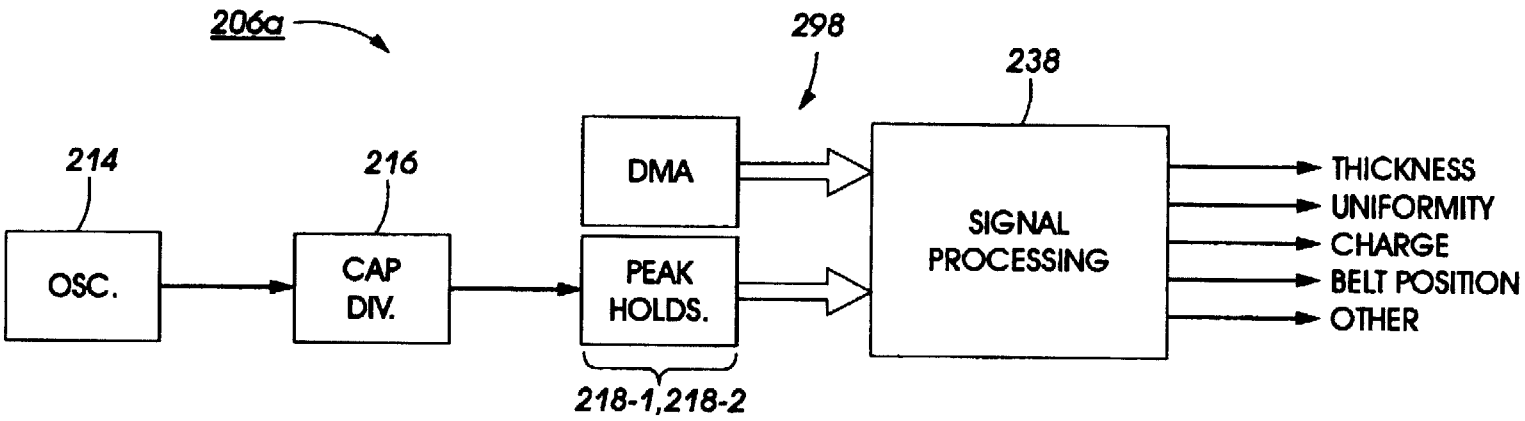
FIG. 4 is a block diagram of a preferred arrangement for the capacitive based sensing system.

Referring to FIG. 4, a preferred embodiment of the capacitive sensing subsystem 206 is designated with the numeral 206*a*. The preferred embodiment of FIG. 4 includes the oscillator 214, the capacitive divider 216 and peak holds 218-1 and 218-2. Essentially, as will appear below, the plurality of peak holds, only one of which is shown in FIG. 3, permit signal processing 238 to generate a plurality of output signals. Referring to the output signals of FIG. 4, further discussion regarding thickness, uniformity and charge related signals is provided below.

With respect to belt position detection, as the edge of a belt (e.g. photoreceptive belt 100 of FIG. 1) moves laterally in and out between two conductive plates, the change in dielectric constant between the belt and air is measured. The resultant capacitance measured will change proportionately with belt position. In one example the peak holds and signal processing capability are implemented on a suitable standard platform, such as a personal computer.

Additionally, it should be appreciated that a capacitive sensing subsystem disposed near a paper delivery station (not shown) for the printing system of FIG. 1 could be used in determining a thickness of a substrate, e.g. a sheet of paper. More particularly, in one example the substrate would be passed through the plates 232, 234 in order to obtain a corresponding capacitance of the substrate. In turn, that capacitance would be processed with the illustrated embodiment of FIG. 4 to obtain a representative value of substrate thickness.

Figure 5:
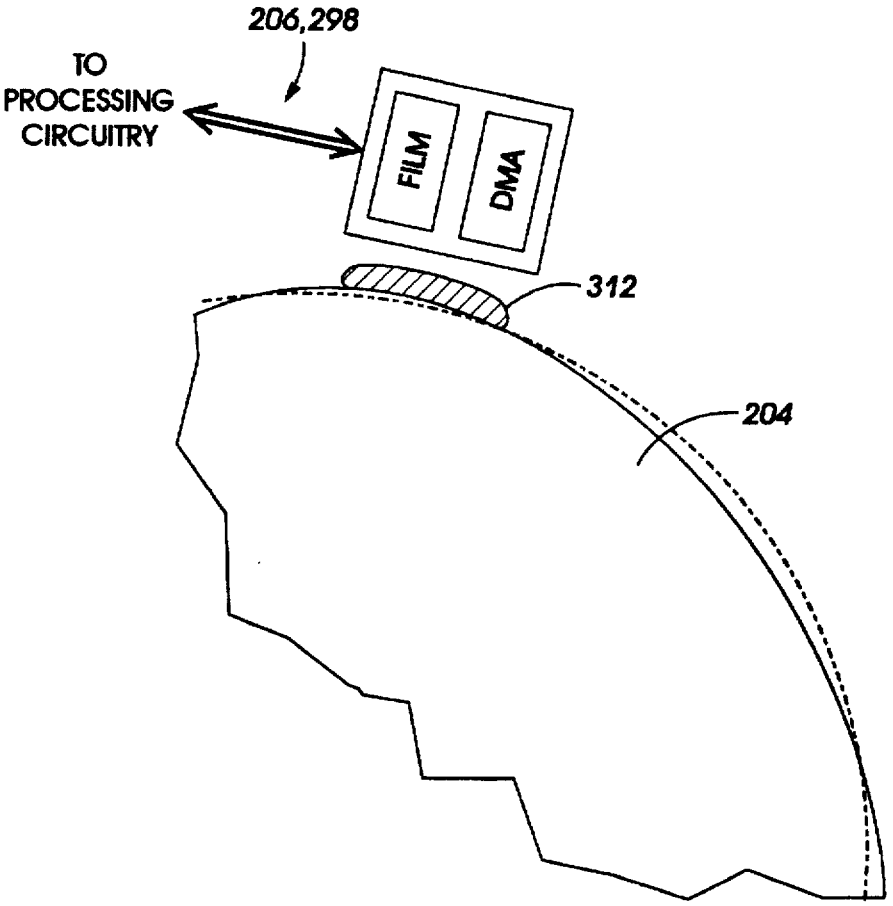
FIG. 5 is a partial view of a drum with a nonuniform cross-section and a discrete amount of developer material disposed thereon.
Figure 6:
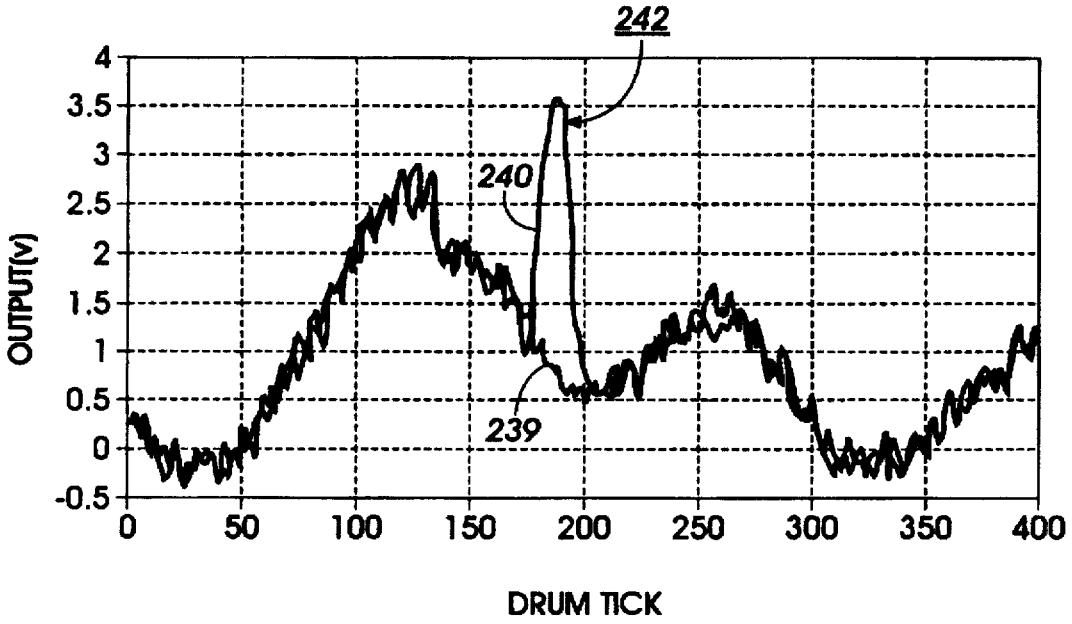
FIG. 6 is a graph showing experimental results obtained through operation of the arrangement of FIG. 2.

Referring to FIG. 5, further discussion regarding roll or drum uniformity measurement is provided. It is understood that many rollers or drums are not perfectly uniform in that they are not necessarily round. In some instances, a roller may have a dome-like portion as shown by the illustrated embodiment of FIG. 5. As will be appreciated, such non-uniformity causes an inaccurate fluctuation in capacitance because the value of d (see relationship for C above) varies from what would be expected if a cross section of the drum were circular throughout. Referring to FIG. 6, the results of an experiment, in which measurements of drum run out (i.e. an indicator of drum roundness) were obtained with the capacitive sensing subsystem 206, are shown. In the illustrated graph of FIG. 6, "drum tick" represents the extent to which the drum has rotated about a reference plane. In one example, 400 drum ticks are equal to about one revolution of the drum.

For the experiment of FIG. 6, first curve 239 and second curve 240 are generated by rotating the application roll 204 (FIG. 2) through two revolutions. During the first revolution, the roll 204 is run through a "clean" cycle in which only drum uniformity or drum run out is monitored. As should be recognized, through much of the first revolution, the values representative of output are above zero. During the second revolution, some liquid developer was squirted on the roll 204 and when the roll reached the capacitive sensing subsystem 206, a corresponding spike resulted. It should be appreciated that this experiment demonstrates an advantage of the disclosed system in that the second curve can be normalized on the basis of the first curve to accommodate for the presence of drum run out. This normalization is enabled through use of relatively high frequency with the oscillator (FIG. 3), such use permitting accurate drum phase synchronization.

Figure 7:
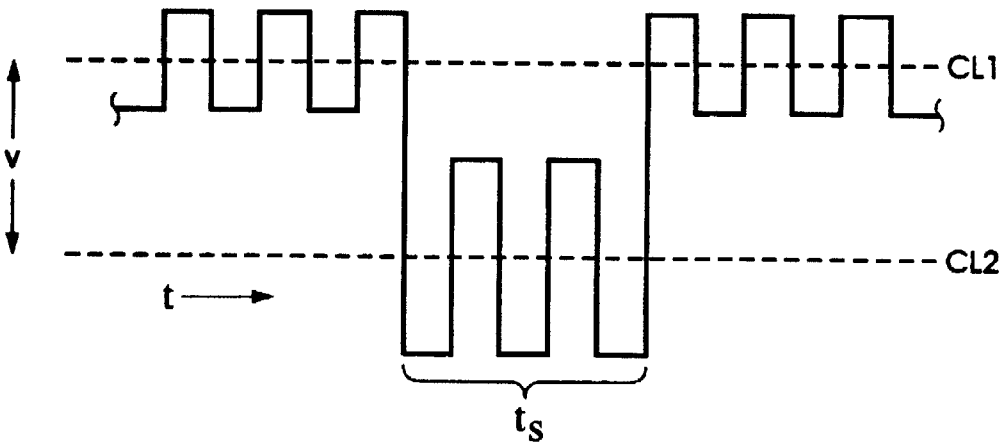
FIG. 7 is a pulse train demonstrating results obtained through the operation of an arrangement such as that shown in FIG. 2.
Figure 8:
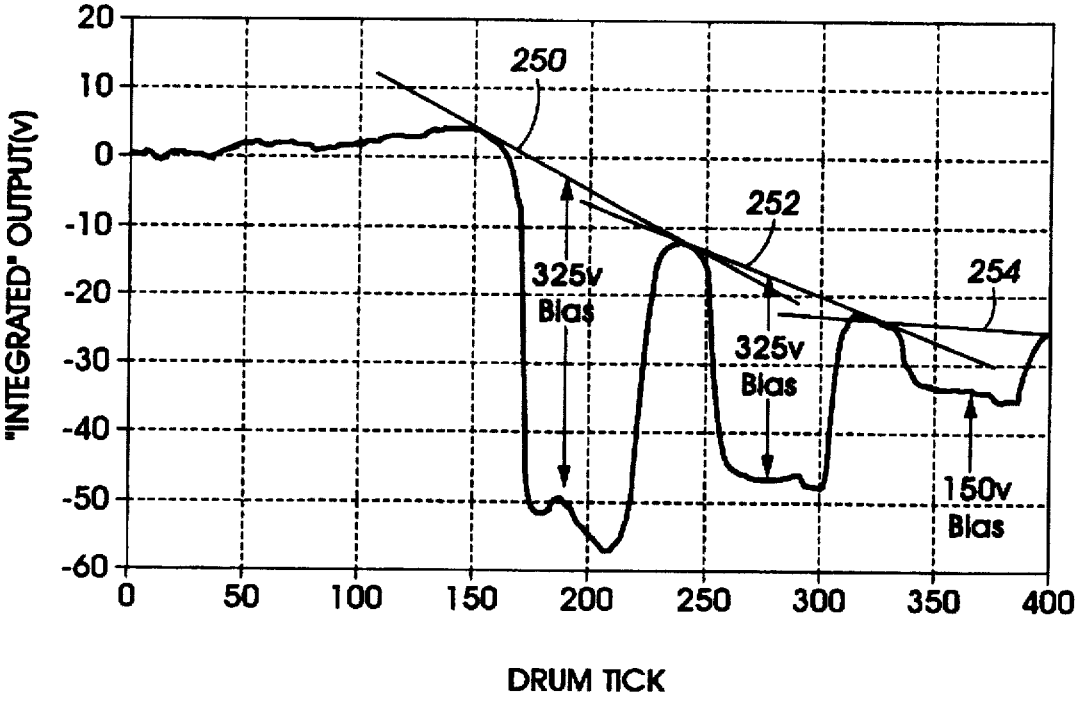
FIG. 8 is a graph of "integrated" results obtained through alternative operation of the arrangement of FIG. 2.

Referring to FIGS. 7 and 8, a discussion of how the preferred embodiment can be used to measure both developer thickness and electrostatic voltage (i.e. charge) is provided. Referring first to FIG. 7, a pulse train, representative of roll or drum voltage for a clean cycle, is characterized by a first centerline, namely "CL1". During the squirt test, the pulse train reflects a change in voltage, during $t_s$, corresponding to a change in peak or peak to peak voltage. It has been found that utilization of peak holds to grab voltages reflecting a voltage from the clean cycle and a voltage during the squirt cycle represents at least one contemplated approach for obtaining a capacitive measurement that is normalized for drum run out. Additionally, during $t_s$, the voltage is shifted in accordance with a second centerline, namely "CL2". It has been found that a measurement of the shift between CL1 and CL2 provides a value representative of electrostatic voltage, which value may be useful in setting a bias voltage for application to the application roll 204.

Referring to FIG. 8, an alternative approach to measuring both developer thickness and electrostatic voltage is described. The curve of FIG. 8 shows "integrated" results for the capacitive sensing subsystem 206 where the integration was achieved by simply summing data points as they were collected during a single pass of the roll 204. Three different bias potentials were used on each pass of the roll to develop different test patches for developed mass per area (DMA). In the illustrated embodiment of FIG. 8, the slope of lines 250, 252 and 254 represent the patch or developer thickness while the area of the "bucket" under those lines represent the charge level of the patch.

Numerous features of the above-described embodiments will be appreciated by those skilled in the art.

First, the capacitive sensing subsystem is easy to construct and extremely cost effective. At the same time, the subsystem is capable of meeting a wide range of sensing demands. Hence, the subsystem should be able to satisfy multiple sensing needs while achieving an acceptable manufacturing cost.

Second, the capacitive sensing subsystem permits a high degree of accuracy in developer material thickness measurement which is not believed to have been available in previous systems. In particular, the failure to accommodate for such factors as drum uniformity can impact the accuracy of a thickness measurement. Through normalization of a developer thickness measurement by reference to a drum run out measurement, accuracy of the thickness measurement is maximized particularly for those cases in which the value of thickness is relatively small.

Finally, the capacitive sensing subsystem permits the determination of certain measurements to be made in parallel. For example, through use of multiple peak holds or a suitable integration process, respective values for developer thickness and electrostatic voltage can be obtained simultaneously.

What is claimed is:

1. In a print development system for a printing system in which a print is developed with developer material and development of the print varies as a function of both a first parameter and a second parameter, wherein the development system includes a capacitance, a sensing system for measuring a first value varying as a function of the first parameter and a second value varying as a function of the second parameter, comprising:

a sensing subsystem for measuring an output by reference to the capacitance; and a signal development subsystem, responsive to said sensing system, for developing, from the output, both a first signal and a second signal with the first signal corresponding to the first value and the second signal corresponding to the second value.

2. The sensing system of claim 1, further comprising a storage subsystem for storing a first set of information relating to the first signal and a second set of information relating to the second signal.

3. The sensing system of claim 2, further comprising a processing subsystem, communicating with said storage subsystem, for processing the first set of information to obtain the first signal and the second set of information to obtain the second signal.

4. The sensing system of claim 3, wherein said storage subsystem includes a circuit for holding one of a portion of the first set of information and a portion of the second set of information for a selected time interval.

5. The sensing system of claim 1, wherein the first and second signals are processed together to obtain a corrected signal for use with the print development system.

6. The sensing system of claim 5, in which the printing system includes a photoreceptor disposed adjacent the print development system and the development system includes an application subsystem for applying developer material to a surface of the photoreceptor, wherein the application subsystem is controllable with the corrected signal.

7. The sensing system of claim 6, wherein the application subsystem includes a roller upon which at least a patch of developer material is disposed.

8. The sensing system of claim 7, wherein the first value corresponds with patch thickness and the second value corresponds with roller uniformity.

9. The sensing system of claim 8, wherein the second value is electronically subtracted from the first value to obtain the corrected value.

10. The sensing system of claim 1, in which the print development system includes an application subsystem for applying developer material, wherein both of the first and second signals are used to control said application subsystem.

11. The sensing system of claim 10, wherein the first signal corresponds with a thickness of a patch of developer material disposed on said application subsystem and the second signal corresponds with an electrostatic voltage of being applied to said application subsystem.

12. The sensing system of claim 1, wherein said sensing subsystem is tuned so that a magnitude corresponding with the second value is insubstantial relative to a magnitude corresponding with the first value.

13. The sensing system of claim 1, in which the print development system includes an application subsystem for applying developer material and the developer material disposed on the application subsystem as a film with a thickness, wherein the first and second signals are used to insure that the film thickness is maintained at less than about 15 microns.

14. In a print development system for a printing system in which a print is developed with developer material and development of the print varies as a function of both a first parameter and a second parameter, wherein the development system includes a capacitance, a method for a first value varying as a function of the first parameter and a second value varying as a function of the second parameter, comprising:

measuring an output by reference to the capacitance; and developing first and second signals from the output with the first signal corresponding to the first value and the second signal corresponding to the second value.

15. The method of claim 14, further comprising storing a first set of information relating to the first signal and a second set of information relating to the second signal.

16. The method of claim 14, in which the print includes a substrate with a thickness, further comprising using one of the first and second signals to determine the substrate thickness.

17. The method of claim 14, further comprising processing the first and second signals together to obtain a corrected signal for use with the print development system.

18. The method of claim 17, in which the printing system includes a photoreceptor disposed adjacent the print development system and the development system includes an application subsystem for applying developer material to a surface of the photoreceptor, further comprising controlling the application subsystem with the corrected signal.

19. The method of claim 17, in which the printing system includes a photoreceptor disposed adjacent the print development system and the development system includes an application subsystem for applying developer material to a surface of the photoreceptor, further comprising controlling the application subsystem with both the first and second signals.

* * * * *